US010882104B2

(12) United States Patent
Gao et al.

(10) Patent No.: US 10,882,104 B2
(45) Date of Patent: Jan. 5, 2021

(54) ALUMINUM ALLOY FOR FORMING AN AXISYMMETRIC ARTICLE

(71) Applicant: GM GLOBAL TECHNOLOGY OPERATIONS LLC, Detroit, MI (US)

(72) Inventors: Lei Gao, Shanghai (CN); Bin Hu, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 439 days.

(21) Appl. No.: 15/574,213

(22) PCT Filed: Jun. 2, 2015

(86) PCT No.: PCT/CN2015/080580
§ 371 (c)(1),
(2) Date: Nov. 15, 2017

(87) PCT Pub. No.: WO2016/192040
PCT Pub. Date: Dec. 8, 2016

(65) Prior Publication Data

US 2018/0126452 A1 May 10, 2018

(51) Int. Cl.

| | |
|---|---|
| ***B22D 21/04*** | (2006.01) |
| ***C22F 1/053*** | (2006.01) |
| ***C22C 21/10*** | (2006.01) |
| ***B22D 17/02*** | (2006.01) |
| ***C22C 21/08*** | (2006.01) |
| ***B22D 15/00*** | (2006.01) |

(Continued)

(52) U.S. Cl.
CPC ..... *B22D 17/02* (2013.01); *B22D 15/005* (2013.01); *B22D 18/02* (2013.01); *C22C 21/08* (2013.01); *C22C 21/10* (2013.01); *C22F 1/053* (2013.01); *B22D 11/003* (2013.01); *C22C 1/026* (2013.01); *C22F 1/002* (2013.01)

(58) Field of Classification Search
CPC .... B22D 11/003; B22D 15/005; B22D 17/02; B22D 18/02; C22C 1/026; C22C 21/08; C22C 21/10; C22F 1/002; C22F 1/053
See application file for complete search history.

(56) References Cited

U.S. PATENT DOCUMENTS

2009/0113713 A1* 5/2009 Tsai ..... B23P 15/00 29/894.324

FOREIGN PATENT DOCUMENTS

CN 1060115 A 4/1992
CN 102251158 A 11/2011
(Continued)

OTHER PUBLICATIONS

Search Report and Written Opinion for application No. PCT/CN2015/080580, dated Mar. 9, 2016, 11 pages.

*Primary Examiner* — Lois L Zheng
(74) *Attorney, Agent, or Firm* — Reising Ethington P.C.

(57) ABSTRACT

A vehicle wheel, or other axisymmetric shaped article, is formed of an aluminum-based alloy by a combination of a liquid forging step of a pre-form shape of the wheel and a subsequent solid-state flow forming step to complete the specified shape of the wheel. An aluminum-based alloy, containing specified amounts of zinc, silicon, and magnesium is devised for use in the forming process. The composition of the aluminum-based alloy is devised to facilitate the performance of each forming step of the article and the mechanical properties of the final shaped product.

20 Claims, 2 Drawing Sheets

(51) Int. Cl.

| | |
|---|---|
| ***B22D 18/02*** | (2006.01) |
| *B22D 17/00* | (2006.01) |
| *B22D 11/04* | (2006.01) |
| *B22D 11/00* | (2006.01) |
| *C22C 1/02* | (2006.01) |
| *C22F 1/00* | (2006.01) |

(56) References Cited

FOREIGN PATENT DOCUMENTS

| | | | | | |
|---|---|---|---|---|---|
| CN | 104611617 | A | | 5/2015 | |
| DE | 102005026829 | | * | 12/2006 | ..... B22D 17/14 |
| FR | 874428 | A | | 8/1942 | |
| JP | 106272001 | A | | 9/1994 | |
| WO | 2015032051 | A1 | | 3/2015 | |

* cited by examiner

ALUMINUM ALLOY FOR FORMING AN AXISYMMETRIC ARTICLE

TECHNICAL FIELD

This invention pertains to the use of an aluminum alloy that is castable in a liquid forging process and then formable in a solid-state flow forming process in the making of axisymmetric articles, such as wheels for an automotive vehicle.

BACKGROUND OF THE INVENTION

Automotive vehicle wheels are an example of articles of manufacture that are produced in large volumes. The manufacture of such high volume products demands continual attention as to the selection of materials used and manufacturing processes employed in order to satisfy design shapes, weight and strength requirements, and to reduce manufacturing costs.

In recent years many automotive vehicle wheels have been formed, in one or more forging steps, from cast billets, using multi-component aluminum-based alloys such as AA 6061. The forged shape includes the hollow hub of the wheel, a radially extending section from which spokes are machined, and a partially formed rim at the circumference of the wheel. The relatively thin rim portion of the wheel may be formed by machining or by flow forming the outer portion of the forging into a thinner axially extending rim configuration for carrying a flexible pneumatic tire. Thus, the forged wheel precursor shape may be machined at various intermediate stages and into its specified final configuration. Such processing is relatively expensive and much of the original aluminum alloy forging is removed by the machining.

Published Application WO/2015/032051, titled Methods and Apparatus to Produce High Performance Axisymmetric Components, published Mar. 12, 2015, and assigned to the assignee of this invention, describes a method of squeeze casting and flow forming an aluminum alloy into the shape of a vehicle wheel. This method can be used to produce a vehicle wheel, for example, with less machining and waste of aluminum alloy starting material. In this disclosed method, molten aluminum alloy is directed into a closed mold cavity and held under a suitable pressure to form a desired shape upon solidification. This pressurized casting step is characterized by the use of the process term "squeeze casting," or more preferably in the present specification. "liquid forging." The solidified, aluminum alloy casting is removed from the mold, and a selected portion of the casting is heated, if necessary, and caused to flow (flow forming) into the specified rim shape, and the wheel is thus brought to a close-to-final shape. The squeeze cast metal may be suitably heat-treated to enhance the flow forming step, and so may the flow formed metal to produce desired properties in the finished axisymmetric product. The elemental components of the aluminum-based alloys, used in illustrations of the squeeze casting/flow forming practice, included three to six weight percent silicon for cast-ability of the molten alloy during squeeze casting, and a total of two to five weight percent of copper, magnesium, and zinc, for subsequent heat-treatment of the flow formed product.

The co-inventors of the subject matter of the WO/2015/032051 application include the two co-inventors of the subject invention. The entire disclosure of WO/2015/032051 is incorporated into this specification by reference.

SUMMARY OF THE INVENTION

Aluminum alloys are often used for making wheels, rollers, discs, and other axisymmetric, generally round articles that are rotated in use. Similar articles that are not rotated in use include liquid and beverage containers, ice containers, gutter tubing, lighting shades, and the like. Often the articles that are rotated in use are subjected to heavier loadings, which may require more complicated structures. They are often shaped with a hub or center of rotation, a generally planar body extending radially from the hub, and a rim or other load-bearing structure extending axially from the circumference or other portion of the radial body. And the respective members of the article are part of an integral or one-piece structure.

When such a load-bearing rim, or like structure, is generally axially-centered on the radial body, the shape of the working article can usually be formed by forging a disk-like ingot, cast from one of many different aluminum alloys. But when the axisymmetrical rim-like structure extends appreciably to one side of the radial portion of the body, and is intended to be subjected to appreciable loading, it is difficult to form the shape of such an axisymmetric article by the forging of an aluminum alloy. In accordance with practices of this invention, a specific aluminum alloy is used in a liquid forging and flow forming process to form such intricate axisymmetric, load bearing shapes with axially-protruding structural members. For purposes of an illustrative example, a preferred embodiment of the practice of our invention will be described as it is used in the making of a wheel for an automotive vehicle. But the practice of the invention is not limited to making wheels. It may be used in making many axisymmetric articles using the subject aluminum alloy.

A wheel for an automotive vehicle, such as a car or truck, is formed as a unitary, round aluminum-based alloy piece, having a hollow central hub defining an axis of wheel rotation, a plurality of supportive spokes, integral with and extending radially outwardly from the hub, and a circumferential rim, formed integrally with the outer ends of the spokes. And the circumferential rim must be sufficiently wide in an axial dimension of the wheel and curvedly shaped in cross-section to sealingly engage a flexible pneumatic tire to be mounted on the rim for use of the wheel. Since each vehicle line may have one or more wheel designs, it is a technical challenge to provide a strong, light-weight metal alloy that is suitable for readily forming different wheel shapes of suitable strength and at an acceptable manufacturing cost.

In accordance with this invention, an aluminum-based alloy is provided for making vehicle wheels, and other axisymmetrical shaped articles of manufacture. The aluminum-based alloy is particularly composed so as to have properties in each of the molten and solid states adapted for forming a wheel design by a process in which an initial (precursor or pre-form) wheel shape is formed by liquid forging of a molten volume of the alloy and, subsequently, at least the rim portion of the wheel (or a specified portion of another article) is further incrementally shaped (or reshaped) by a solid-state flow forming step. The elemental composition of the aluminum-based alloy, by weight percentage, is 3.0-4.0% zinc, 1.8-2.5% silicon, 1.3-2.0% magnesium, 0.2-0.5% manganese, 0.15-0.2% titanium, 0.05% maximum copper, 0.1% maximum iron, 0.05% maximum other individual elements or materials, 0.15% maximum total other elements or materials, and the balance aluminum. Aluminum-based alloys of these compositions may be referred to as LF-FF aluminum-based alloys in this specification. The properties of this aluminum-based alloy are balanced to provide (i) suitable liquid flow of the alloy at a liquid forging temperature in a closed mold cavity to form a preform shape of an axisymmetrical article, (ii) suitable elevated temperature solid-state flow of the solidified liquid forged shape (preferably, after a softening heat-treatment) to further refine the shape of a portion of the article, and (iii) necessary physical properties in each portion of the final shaped wheel or other article after a hardening heat-treatment (T6 heat-treatment). The LF-FF aluminum-based alloy is intended to enable close-to-final shape forming of the wheel by the sequential liquid forging and solid state flow forming steps so as to reduce the need for machining of the formed wheel.

As stated, these LF-FF aluminum alloys are particularly adapted for the liquid forging of a precursor wheel structure and subsequent flow forming of at least a portion of the liquid forged precursor wheel shape. In many practices of the invention, it will be a liquid forged shape of the rim portion of the wheel that will require the further flow forming step to obtain a desired wheel shape or other axismmetrical article shape. In general, it is preferred to form an initial rim shape (in the liquid forged, pre-form wheel structure) that is subsequently incrementally re-shaped by flow forming to form a stronger and grain refined rim structure.

The liquid forging step is performed by pushing a predetermined volume of the molten LF-FF aluminum alloy, at a temperature in the range of about 650° C. to 750° C., into a heated mold cavity, defined by separable, facing, complementary mold members, carried in a suitable press structure, for forming the precursor wheel shape. Preferably, the mold members are maintained closely about a predetermined temperature in the range of 180° C. to 260° C. for the liquid forging step. A predetermined liquid forging pressure is maintained on the molten alloy as it is cooled and solidified in the mold cavity. The mold cavity may be shaped to form the hub and spoke portions of the wheel to close-to-final shape and to form the rim portion to a preform or precursor shape, preparatory to solid state flow forming of the rib portion to a close to final shape.

After the liquid forged preform wheel body is solidified and cooled to the mold temperature, it is ejected from its mold. In a preferred embodiment of the invention, the liquid forged wheel is subjected to a heat-treatment step to soften the pre-form for a solid state flow-forming step of at least the rim portion of the cast wheel body. Such a softening heat-treatment is described in more detail below in this specification.

The pre-form wheel shape is heated, if necessary, to a rim-forming temperature of about 250° C. to about 370° C. for the LF-FF aluminum alloy. The warmed liquid forged shape is transferred to a suitable supporting apparatus for the application of one or more shaped rollers (or the like complementary forming tools) to a surface of the precursor rim portion. The inner side of the rim portion is supported on a mandrel (which may be rotated), or other working surface, against which the aluminum alloy metal may flow. The roller, or other shaping tool, is pressed against the upper surface of the workpiece to incrementally flow and displace the rim metal against the mandrel and into a desired rim configuration. Suitable lubricants and/or shaping tool surfaces may be used in the flow-forming operation.

Such forming of the LF-FF aluminum alloy can produce a complex wheel configuration that requires minimal machining to obtain a specified finish shape. The LF-FF aluminum alloy can be heat-treat softened after liquid forging to enhance flow forming. And the flow formed shape can be heat-treat hardened to provide enhanced strength in the finished wheel.

Other objects and advantages of the LF-FF aluminum alloy and the subject axisymmetric article-making process will become more apparent from a specific illustrative example as presented in the following paragraphs of this specification.

DESCRIPTION OF PREFERRED EMBODIMENTS

Figure 1:
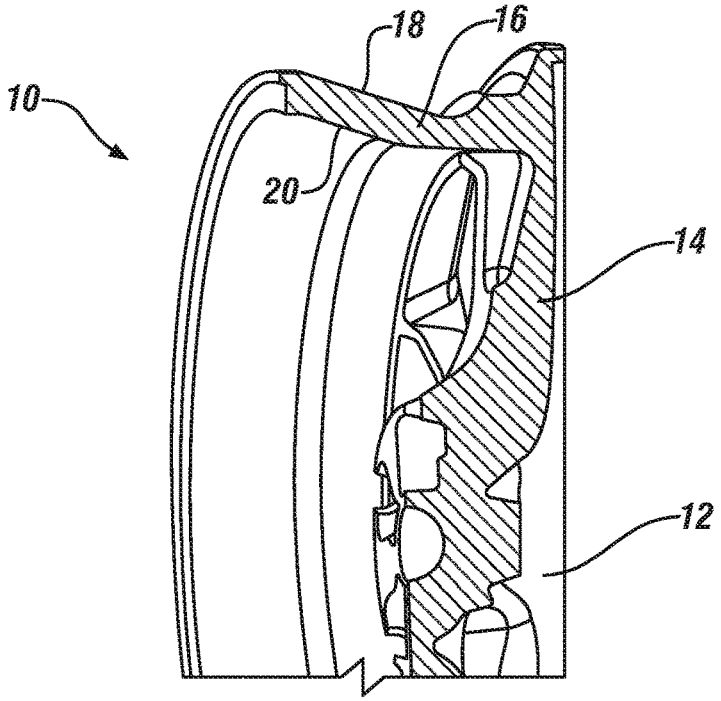
FIG. 1 is a fragmentary, side, cross-sectional view of a liquid forged preform of a vehicle wheel.

FIG. 1 is a diametrical cross-section of the upper half of a liquid forged, pre-formed, integral wheel structure 10 of an aluminum-based alloy, which is formulated to be processed in accordance with this invention to form wheels for an automotive vehicle. The liquid forged preformed wheel structure 10 comprises a central hub 12, several radial spokes 14, and a precursor or pre-formed rim structure 16. The respective members of the pre-formed wheel structure 10 are integrally formed of an LF-FF aluminum-based alloy. The central hub 12 is shaped to define an axis of rotation of the wheel. Several radially extending, equal length spokes 14 (for example, five to eight spokes) lie in a plane transverse to the axis of rotation of hub 12. One end of each of the spokes is integrally formed with the outer surface of the hub 12. The radially outward end of each of the spokes is integrally connected with a circumferential pre-formed rim structure 16. In this illustration, circumferential pre-formed rim structure 16 extends axially, in one direction, from the plane of the spokes 14. In the final shape of the wheel, the radially outward surface 18 and radially inward surface 20 of pre-formed rim structure 16 will be re-sized and re-shaped to a final shape to sealingly engage a pneumatic tire in the use of the wheel. But in this liquid forged, pre-form structure of wheel 10, the pre-formed rim structure 16 has not attained its final shape. The final shape and the physical properties of the rim are important in the final wheel structure. It is preferred to form a precursor shape of the rim portion by liquid forging and to subsequently heat-treat the pre-form wheel shape 10 to soften the pre-formed rim structure 16 portion and to "flow form" and subsequently heat-treat the precursor shape of the pre-formed rim structure portion to its final shape and physical properties.

Figure 4:
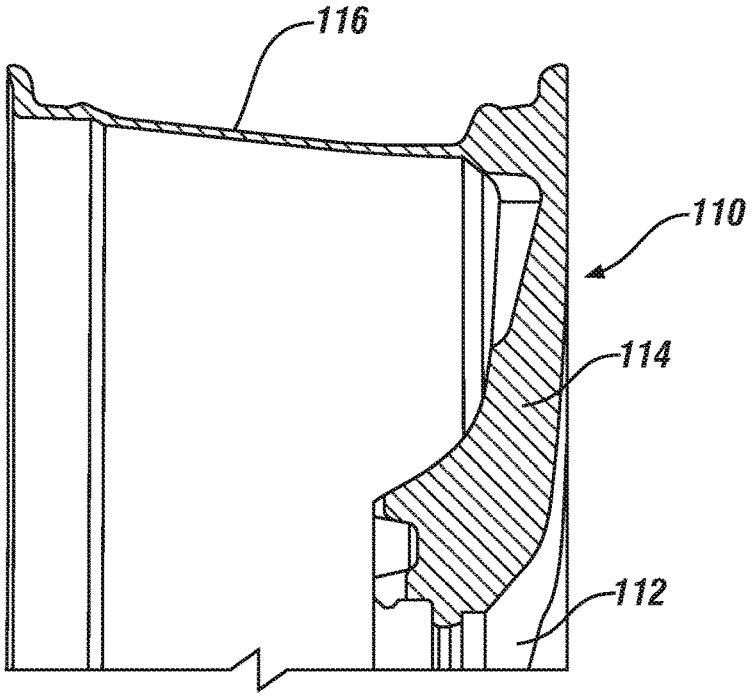
FIG. 4 is a side cross-sectional view of a portion of the vehicle wheel with the rim portion flow formed to its intended shape.

The pre-form structure of wheel 10 is formed by liquid forging using an aluminum-based alloy that facilitates the forming of the pre-form wheel structure 10 and the subsequent solid-state flow forming of its pre-form rim portion 16 to a final rim shape (like rim 116 in FIG. 4). The elemental composition of the aluminum-based alloy, by weight, is 3.0-4.0% zinc, 1.8-2.5% silicon, 1.3-2.0% magnesium, 0.2-0.5% manganese, 0.15-0.2% titanium, 0.05% maximum copper, 0.1% maximum iron, 0.05% maximum other individual elements or materials, 0.15% maximum total other elements or materials, and the balance aluminum. Again, the family of aluminum-based alloys having such compositions is referred to in this specification as LF-FF aluminum alloys.

Figure 2:
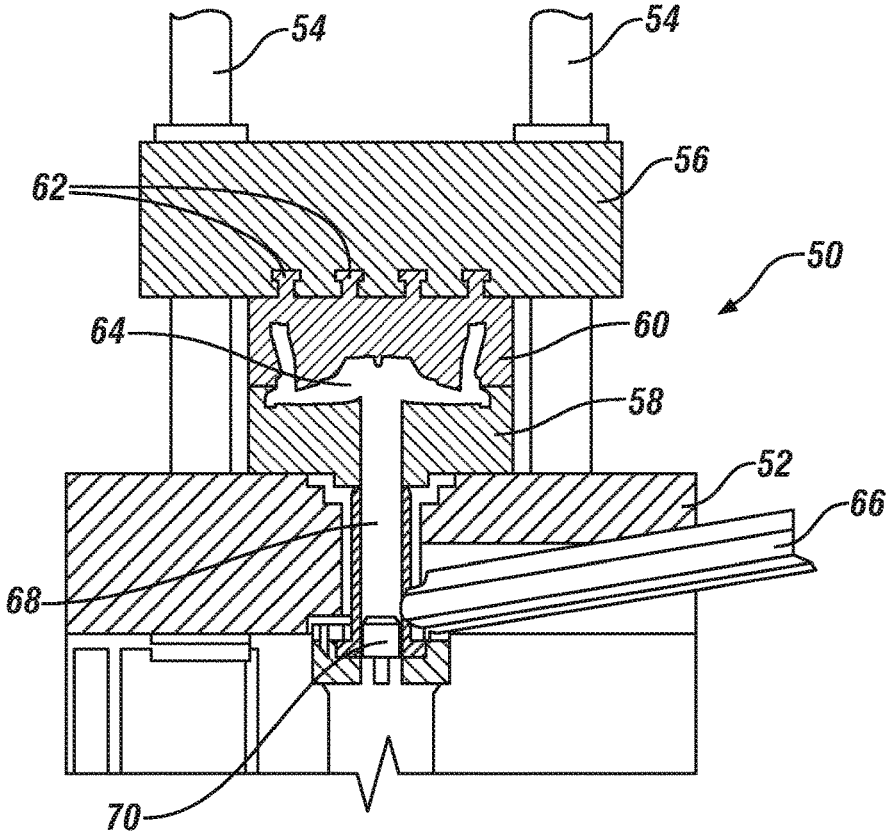
FIG. 2 is a front and cross-sectional view of a vertically-actuated press with upper and lower mold pieces with mating cavities for liquid forging of a precursor wheel structure. Molten aluminum alloy is delivered from the right side of the illustrated press, through the lower mold member into the wheel shape cavity defined by the press-closed mold members. Pressure is applied to the metal in the closed molds by a plunger acting upwardly through the shot sleeve.

FIG. 2 illustrates a front, cross sectional view of equipment and tooling for the making of the liquid forged pre-form structure of wheel 10. In FIG. 2, vertically-actuated press 50 comprises lower platen 52 which carries four vertical columns 54 (the front two columns being visible in FIG. 2). Press 50 further comprises an upper platen 56 which is movable, by means not illustrated, on vertical columns 54. A lower mold section 58 is affixed to lower platen 52 and a complementary upper mold section 60 is attached by connectors 62 to upper platen 56.

Complementary and facing cavity portions for the liquid forging of pre-form wheel structure 10 are formed in lower mold section 58 and upper mold section 60. When the mold sections 58, 60 are closed, their complementary cavities define cavity 64 for the liquid forging of pre-form wheel shape 10. Mold sections 58, 60 contain suitable passages (not illustrated) for the flow of a liquid oil-base heating medium which is managed to maintain both of the mold sections at a temperature in the range of 180° C. to 260° C. The liquid oil-base is circulated from outside of mold sections 58, 60, and its temperature is closely controlled. A specific heating medium temperature is predetermined for a specific article shape and LF-FF aluminum alloy and preferably the temperature of the mold members 58, 60 is maintained within ±5° C. of this predetermined temperature (in the range of 180° C. to 260° C.) by control of the heating oil temperature. Upper mold section 60 may also contain ejector pins (not shown) for removal of the liquid forged wheel or other article from the mold members when the article has solidified and been cooled to about the mold temperature.

A molten LF-FF aluminum alloy is prepared under a suitably protective atmosphere at a suitable predetermined temperature in the range of about 650° C. to 750° C. A more specific or narrow temperature range for the molten alloy may be determined for each liquid forging job depending on the specific alloy composition, the shape of the mold cavity 64 and the mass of the liquid forged wheel structure 10 to be formed. A volume of the molten LF-FF alloy is transferred from a holding vessel through a suitably enclosed melt transfer passage 66 into shot sleeve 68. Access to the shot sleeve 68 is than closed and piston (or punch) 70 is actuated to force the charge of molten aluminum alloy from shot sleeve 68 into cavity 64 formed by closed molds 58, 60. Cavity 64 may be suitably vented, if necessary, to enable liquid aluminum alloy to fully fill the cavity 64 and engage all surfaces of the cavity. Piston 70 may be mechanically or hydraulically actuated by means not shown, and is capable of exerting a suitable predetermined liquid forging force (or pressure) on the molten aluminum LF-FF alloy that is pushed into cavity 64. A forging force of about 3,000 tons is typically applied by piston 70 in this liquid forging step. This application of liquid forging force is maintained until the pre-form wheel shape has solidified for opening of the mold members 58, 60 and removal of the liquid forged pre-form wheel 10 from them. The temperature of the solidified wheel shape or other articles will typically be in the temperature range of 180° C. to 260° C. when it is removed from mold members 58, 60.

In the development of a specific LF-FF aluminum alloy and liquid forging process for a specific preform wheel shape (e.g., like wheel shape 10 in FIG. 1) it will be desirable to determine the physical properties of the liquid forged pre-form wheel structure. This may be done, for example, by cooling a liquid forged wheel sample to an ambient temperature to determine mechanical properties of the pre-formed wheel specimen. In general, it is preferred that a test specimen from at least the rim portion of the liquid forged wheel pre-form shape be removed and that its yield strength and tensile strength be determined at about room temperature (for example, 18° C.-28° C.). Preferably, both the outer rim portion and inner rim portion of the solid wheel shape removed from the mold cavity has a yield strength of at least 139 MPa and a tensile strength of at least 249 MPa and an elongation of two percent or higher, each determined on a test specimen at 25° C.

At this stage of the processing, the wheel preform shape 10 (except for the pre-form rim structure portion 16) is substantially formed to its final shape and dimensions. In the event that any finish machining is required, it may be performed at this time, or subsequently, after the rim portion has been re-shaped by flow forming.

The pre-form rim structure portion 16 of the liquid forged wheel pre-form 10 shape now requires thinning and lengthening. This may be accomplished, for example, by simultaneously exerting roller pressure on both the outer radial surface 18 and the inner radial surface 20 of the pre-form rim structure 16 as the wheel is rotated, a spinning flow forming process, to reach a final (or near to final) shape as depicted at rim portion 116 in FIG. 4. As stated, flow forming forces will be applied to its radially outer surface 18 and radially inward surface 20. Before the solid-state flow forming of pre-form rim structure 16 is started, it is preferred to subject the preformed wheel 10, or at least pre-formed rim portion 16, to a softening heat-treatment. This is accomplished by heating the pre-formed wheel structure 10 in air to a temperature in the range of about 450° C. to about 500° C., and upon reaching this temperature, re-cooling the pre-formed wheel structure in ambient air.

Following the softening heat-treatment process step, it may be desirable to determine the mechanical properties of at least the heat-treated rim portion of the pre-form wheel shape. In general, it is preferred that a test specimen obtained from at least the rim portion of the liquid forged wheel pre-form shape be removed and its yield strength and tensile strength be determined. Preferably, the rim portion of the solid wheel shape removed from the mold cavity has a yield strength of at least 152 MPa and a tensile strength of at least 287 MPa and an elongation of twenty one percent or higher, each determined on a test specimen at 25° C. The rim portion 16 of the pre-form wheel structure 10 is now much more formable and is ready for the flow forming step to deform the solid-state rim to its final shape and dimensions.

Figure 3:
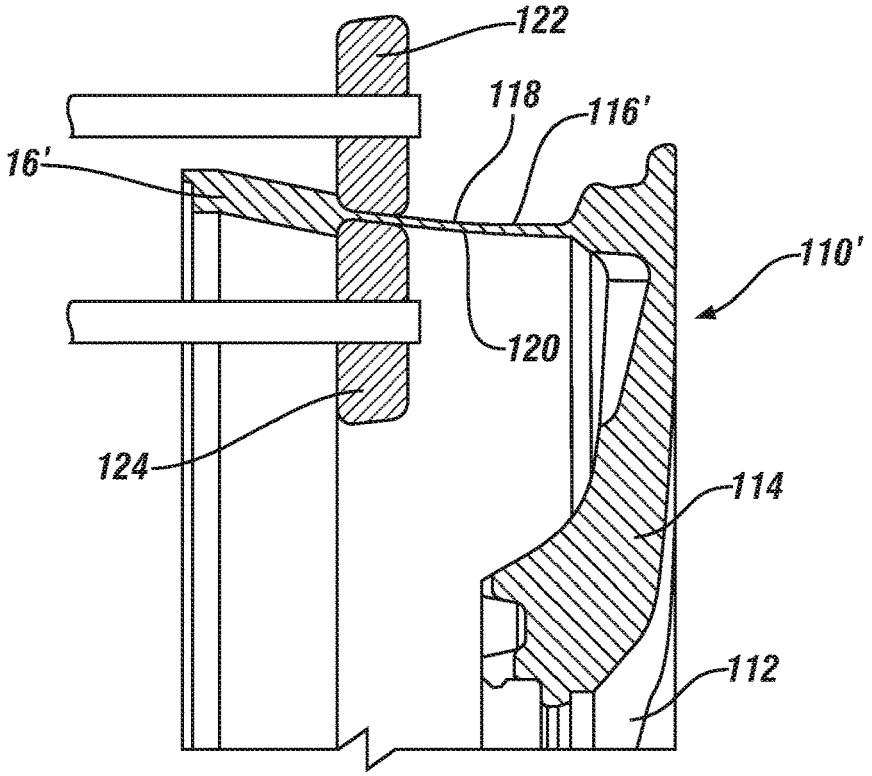
FIG. 3 is a side cross sectional illustration of a portion of the liquid forged precursor shape of the wheel with an inner roller working on the inside of its preformed rim structure and with an outer roller applying flow forming pressure to the outer side of the rim structure to cooperatively incrementally flow the solid-state aluminum alloy material into its final rim shape.

The pre-form wheel structure 10, or at least rim portion 16, is heated in air to a temperature in the range of 300° C. to 420° C. The preheated wheel structure 10 with pre-formed rim portion 16 is then suitably supported for rotation in an ambient workplace environment and spun and subjected to solid-state flow forming of the rim to obtain a finished rim shape as illustrated, for example, as rim structure 116 in FIG. 4. The heated pre-form wheel structure 110' (referring to FIG. 3) may be placed on a suitable support, such as on a spindle (not illustrated), that engages the wheel 110' at its hollow hub 112 for spinning at a predetermined rate of rotations per minute. Then, a first roller 122, serving as a mandrel, may be pressed against the preheated inner rim surface 120 and a second working roller 124 pressed against the outer rim surface 118 with sufficient force and relative movement along the surfaces 118, 120 of the rim 116' to reshape the rim structure from the pre-form rim shape 16 of FIG. 1 to final (or near-final) rim shape 116 of FIG. 4. The rollers 122, 124 are pressed into and moved along the rim surfaces at predetermined rates of advancement of, for example, millimeters of penetration per rotation of the wheel. In FIG. 3, a portion 116' has been re-shaped, and a portion 16' remains to be re-shaped. This reshaping of original pre-form rim shape 16 is performed around the entire circumference of the original liquid forged pre-form rim 16, preferably starting from the spoke side of the pre-form rim 16, so as to reduce the thickness of the preformed rim, refine its shape, and to increase is axial length to obtain the finished shape of rim 116 of wheel 110 as illustrated in FIG. 4.

In the wheel spinning method of flow forming the heated rim of the wheel, the wheel may, for example, be rotated at a rate of 1000 to 1400 rotations per minute, and the rollers may be fed into the rim surfaces at a rate of, for example, 0.25 to 0.80 millimeters per each rotation of the wheel. The solid-state flow forming of pre-form rim structure 16 (FIG. 1) to finished (or near finished) rim structure 116 (FIG. 4) may be accomplished using any suitable supporting and shaping tools for carefully incrementally spinning, and elongating and thinning the pre-form rim shape 16.

In this example, the spokes 114 and hub 112 of wheel 110 are not further shaped by flow forming. Their final shape, or near-to-final shape, is attained in the liquid forging step.

Following the solid-state flow-forming of the preform wheel structure 10 to obtain wheel structure 110, it is preferred to subject the wheel structure 110 to a T6 type hardening heat-treatment to impart the desired strength and hardness properties to the LF-FF aluminum alloy wheel structure. Further, any final trimming or machining of the wheel may be performed. In general, it is believed that the use of the specified LF-FF aluminum alloy permits suitable shaping of the wheel by the combination of the liquid forging step and the solid-state flow forming step and little, if any, machining and removal of aluminum alloy metal will be required.

The formed wheel structure 110 is heated in air in a suitable furnace, or the like, to a temperature in the range of 480° C. to 530° C. for a period of, for example, fifteen to thirty-five minutes. The wheel 110 is then quenched into warm water at, e.g., about 70° C. The wheel, thus formed of the LF-FF aluminum-based alloy, has a yield strength of at least about 300 MPa and a tensile strength of at least about 350 MPa and an elongation of at least about 10 percent, measured at 25° C. These properties compare very favorably with wheels that are formed by the forging (and re-forging) of AA6061 workpieces.

Thus, the use of the LF-FF aluminum-based alloy in combination with a suitable liquid forging step and a solid-state flow forming step is capable of producing light weight, high strength wheels for automotive vehicles. The use of the LF-FF aluminum-based alloy and the processing steps may also be beneficially used to make other axisymmetric articles having a projecting structure with a shape that is difficult to form by liquid forging in a mold cavity in which the other portions of the integral article can be formed in substantially their finished shapes and sizes.

Intermediate heat-treatment steps enhance the processing of the alloy and the properties of the intermediate and final products. The required number of manufacturing steps is minimized. And the specified LF-FF aluminum alloy lends itself to the forming of wheels and other axisymmetric articles with exceptional physical properties and durability.

The invention claimed is:

1. A method of forming an integral wheel structure, the integral wheel structure comprising a hub having an axis of rotation, a plurality of equal length spokes extending radially outwardly from the hub, in a plane that is perpendicular to the axis of rotation of the hub, to a circumferential rim at the radially outer ends of the spokes, the circumferential rim having a predetermined width extending transverse to the plane of the spokes and having a thickness and shape for sealing engagement with a flexible pneumatic tire to be placed on the rim for use of the wheel structure, the integral wheel structure being formed of an aluminum-based alloy by the method comprising:

injecting a mold-filling volume of a molten aluminum-based alloy into a mold cavity, the cavity having surfaces formed by separable, facing mold members and maintaining a predetermined pressure on the molten aluminum-based alloy to force the molten alloy into full conformance with the surfaces of the cavity, the molten aluminum base alloy having a composition consisting essentially, by weight, of 3.0-4.0% zinc, 1.8-2.5% silicon, 1.3-2.0% magnesium, 0.2-0.5% manganese, 0.15-0.2% titanium, 0.05% maximum copper, 0.1% maximum iron, and the balance aluminum, the surfaces of the cavity substantially defining predetermined shapes of the hub and spokes in the integral wheel structure to be formed, and a pre-form shape of the circumferential rim that has a larger thickness and shorter width than the desired shape of the rim in the integral wheel structure to be formed;

cooling the molten aluminum-based alloy to form a solid pre-form wheel shape and removing the solid pre-form wheel shape from the facing mold members; and applying a mechanical forming force to the pre-form shape of the circumferential rim of the solid pre-form wheel shape at a predetermined temperature above ambient temperature to obtain solid-state flow of the aluminum-based alloy metal and to form the circumferential rim into its intended shape in the integral wheel structure.

2. A method of forming an integral wheel structure as stated in claim 1 in which the temperature of the volume of molten aluminum-based alloy injected into the mold cavity is in the range of 650° C. to 750° C.

3. A method of forming an integral wheel structure as stated in claim 1 in which the facing mold members are maintained at a temperature in the range of 180° C. to 260° C. during the formation of the solid pre-form wheel shape.

4. A method of forming an integral wheel structure as stated in claim 1 in which the facing mold members are maintained at a temperature in the range of 180° C. to 260° C. during the formation of the solid pre-form wheel shape and the solid pre-form wheel shape is removed from the mold members at a temperature in the range of 180° C. to 260° C.

5. A method of forming an integral wheel structure as stated in claim 1 in which the rim portion of the solid pre-form wheel shape removed from the mold cavity has a yield strength of at least 139 MPa and a tensile strength of at least 249 MPa and an elongation of two percent or higher, each determined on a test specimen at 25° C.

6. A method of forming an integral wheel structure as stated in claim 1 in which the solid pre-form wheel shape is subjected to a softening heat-treatment at 450° C. to 500° C. in air before solid state flow forming of the rim-forming portion of the solid pre-form wheel shape.

7. A method of forming an integral wheel structure as stated in claim 6 in which the softened solid pre-form wheel shape has a yield strength of at least 150 MPa and a tensile strength of at least 287 MPa and an elongation of at least twenty one percent, each determined on a test specimen at 25° C.

8. A method of forming an integral wheel structure as stated in claim 1 in which at least the rim-forming portion of the solid pre-form wheel shape is heated to a temperature in the range of 250° C. to 370° C. and the forming force is applied to the heated rim portion of the solid pre-form wheel shape.

9. A method of forming an integral wheel structure as stated in claim 1 in which, following the forming of the rim of the integral wheel structure, the integral wheel structure is subjected to hardening heat-treatment in air at a temperature in the range of 480° C. to 530° C. and is thereafter quenched in water.

10. A method of forming an integral wheel structure as stated in claim 9 in which integral wheel structure has a yield strength of at least 300 MPa and a tensile strength of at least 350 MPa and an elongation of at least ten percent, each determined on a test specimen at 25° C.

11. A method of forming an integral wheel structure, the integral wheel structure comprising a hub having an axis of rotation, a plurality of equal length spokes extending radially outwardly from the hub, in a plane that is perpendicular to the axis of rotation of the hub, to a circumferential rim at the radially outer ends of the spokes, the circumferential rim having a predetermined width, extending transverse to the plane of the spokes, and having a thickness and shape for sealing engagement with a flexible pneumatic tire to be placed on the rim for use of the integral wheel structure, the integral wheel structure being formed of an aluminum-based alloy by the method comprising:

injecting a mold-filling volume of a molten aluminum-based alloy into a cavity of a mold, the mold being maintained at a temperature in the range of 180° C. to 260° C., the molten aluminum-based alloy being at a temperature in the range of 650° C. to 750° C., and maintaining a predetermined pressure on the molten aluminum-based alloy to force the molten alloy into full conformance with the surfaces of the cavity, the molten aluminum base alloy having a composition consisting essentially, by weight, of 3.0-4.0% zinc, 1.8-2.5% silicon, 1.3-2.0% magnesium, 0.2-0.5% manganese, 0.15-0.2% titanium, 0.05% maximum copper, 0.1% maximum iron, and the balance aluminum, the surfaces of the cavity substantially defining predetermined shapes of the hub and spokes and a pre-form shape of the circumferential rim that has a larger thickness and shorter width than the desired shape of the rim in the integral wheel structure to be formed;

cooling the molten aluminum-based alloy to form a solid wheel pre-form shape and removing the solid wheel pre-form shape from the facing mold members;

heating the solid wheel pre-form shape in air to soften the solid wheel pre-form shape for shaping of the circumferential rim of the wheel;

applying a mechanical forming force to the pre-form shape of the circumferential rim of the wheel at a predetermined temperature above ambient temperature to obtain solid-state flow of the aluminum-based alloy metal and to form the circumferential rim into its intended shape in the integral wheel structure.

12. A method of forming an integral wheel structure as stated in claim 11 in which the facing mold members are maintained at a temperature in the range of 180° C. to 260° C. during the formation of the solid wheel pre-form shape and the solid wheel pre-form shape is removed from the mold members at a temperature in the range of 180° C. to 260° C.

13. A method of forming an integral wheel structure as stated in claim 11 in which the solid wheel pre-form shape is subjected to a softening heat-treatment at 450° C. to 500° C. in air and then cooled in air before forming of the rim-forming portion of the solid wheel pre-form shape.

14. A method of forming an integral wheel structure as stated in claim 11 in which at least the rim-forming portion of the solid pre-form wheel shape is heated to a temperature in the range of 250° C. to 370° C. and the forming force is applied to the heated rim portion of the solid wheel pre-form shape.

15. A method of forming an integral wheel structure as stated in claim 11 in which at least the pre-form shape of the circumferential rim is heated to a temperature in the range of 250° C. to 370° C., the wheel is rotated, and forming rollers are pressed against surfaces of the circumferential rim to progressively deform it into its intended rim shape for the integral wheel structure.

16. A method of forming an integral wheel structure as stated in claim 11 in which, following the forming of the rim of the integral wheel structure, the integral wheel structure is subjected to hardening heat-treatment in air at a temperature in the range of 480° C. to 530° C. and is thereafter quenched in water.

17. A method of forming an integral article of manufacture having an axisymmetrical shape, the integral article comprising a center portion having a central axis, a body structure extending radially outwardly from the center portion, in a plane that is perpendicular to the central axis of the center portion, to a circumferential perimeter, and an axisymmetric member, axisymmetric with respect to the axis of the center portion, extending a predetermined length outwardly from and transverse to the radial plane of the body structure, the axisymmetric member having a thickness and shape, the integral article being formed of an aluminum-based alloy by the method comprising:

injecting a volume of a molten aluminum-based alloy into a mold cavity and filling the mold cavity, the mold cavity having surfaces formed by separable, facing mold members and maintaining a predetermined pressure on the molten aluminum-based alloy to force the molten alloy into full conformance with the surfaces of the cavity, the molten aluminum base alloy having a composition consisting essentially, by weight, of 3.0-4.0% zinc, 1.8-2.5% silicon, 1.3-2.0% magnesium, 0.2-0.5% manganese, 0.15-0.2% titanium, 0.05% maximum copper, 0.1% maximum iron, and the balance aluminum, the surfaces of the mold cavity substantially defining predetermined shapes of the center portion and body structure, and a pre-form shape of the axisymmetric member, the pre-form shape having a larger thickness and shorter length than the desired shape of the axisymmetric member in the integral article;

cooling the molten aluminum-based alloy to form a solid article pre-form shape and removing the solid article pre-form shape from the facing mold members; and applying a mechanical forming force to the pre-form shape of the axisymmetric member of the article at a predetermined temperature above ambient temperature to obtain progressive incremental solid-state flow of the aluminum-based alloy metal to form the axisymmetric member into its intended final shape in the formed integral article.

18. A method of forming an integral article as stated in claim 17 in which the temperature of the volume of molten aluminum-based alloy injected into the mold cavity is in the range of 650° C. to 750° C.

19. A method of forming an integral article as stated in claim 17 in which the facing mold members are maintained at a temperature in the range of 180° C. to 260° C. during the formation of the solid article pre-form shape.

20. A method of forming an integral article as stated in claim 17 in which at least the axisymmetric member portion of the article shape is heated to a temperature in the range of 250° C. to 370° C. and the forming force is applied to the heated axisymmetric member portion of the solid article pre-form shape.

* * * * *